US006193815B1

(12) United States Patent
Wada et al.

(10) Patent No.: US 6,193,815 B1
(45) Date of Patent: Feb. 27, 2001

(54) COMPOSITION AND PROCESS FOR TREATING THE SURFACE OF ALUMINIFEROUS METALS

(75) Inventors: Hiroyuki Wada; Kazuya Nakada, both of Kanagawa-Ken (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 08/983,599

(22) PCT Filed: Jun. 25, 1996

(86) PCT No.: PCT/US96/10683

§ 371 Date: Dec. 29, 1997

§ 102(e) Date: Dec. 29, 1997

(87) PCT Pub. No.: WO97/02369

PCT Pub. Date: Jan. 23, 1997

(30) Foreign Application Priority Data

Jun. 30, 1995 (JP) ..... 7-166243

(51) Int. Cl.[7] ..... C23C 22/07

(52) U.S. Cl. ..... 148/247; 148/253; 428/470; 252/387

(58) Field of Search ..... 148/259, 247, 148/250, 255, 253, 262; 428/470; 252/387

(56) References Cited

U.S. PATENT DOCUMENTS

| | | | | |
|---|---|---|---|---|
| 2,331,196 | * | 10/1943 | Jernstedt et al. | 148/250 |
| 2,438,877 | | 3/1948 | Spruance, Jr. | 148/6.16 |
| 2,502,441 | * | 4/1950 | Dodd et al. | 148/259 |
| 2,854,368 | * | 9/1958 | Shreir | 148/255 |
| 4,017,334 | * | 4/1977 | Matsushima et al. . | |
| 4,136,073 | * | 1/1979 | Muro et al. | 148/247 |
| 4,148,670 | | 4/1979 | Timm | 148/6.15 R |
| 4,265,677 | * | 5/1981 | Muller et al. | 148/262 |
| 5,143,562 | | 9/1992 | Boulos | 148/247 |
| 5,342,456 | * | 8/1994 | Dolan | 148/247 |
| 5,449,415 | * | 9/1995 | Dolan | 148/259 |

FOREIGN PATENT DOCUMENTS

| | | |
|---|---|---|
| 273704 | 6/1951 | (CH) . |
| 4401566 | 1/1994 | (DE) . |
| 0015020 | 5/1980 | (EP) . |
| 0178020 | 3/1985 | (EP) . |
| 0411606 | 1/1990 | (EP) . |
| 2014617 | 2/1979 | (GB) . |
| 2259920 | 9/1992 | (GB) . |
| 52-131937 | 11/1977 | (JP) . |
| 57-039314 | 3/1982 | (JP) . |
| 1246370 | 10/1989 | (JP) . |
| 9502077 | 7/1994 | (WO) . |
| 9504169 | 7/1994 | (WO) . |
| 9533869 | 6/1995 | (WO) . |
| 9607772 | 8/1995 | (WO) . |

OTHER PUBLICATIONS

"Chemical Abstracts" vol 104, No. 16, p. 251, Abstract No. 133978n. Chocholousek, J. "Composition for Forming Amorphous Phosphate Coatings on Steel and Cast Iron". Dec. 15, 1985.

"Chemical Abstracts" vol. 90, Abstract No. 2087618. Nagae, Yoshio "Surface Treatment of Aluminum and Aluminum Alloys". Feb. 23, 1979.

* cited by examiner

*Primary Examiner*—John Sheehan
*Assistant Examiner*—Andrew L. Oltmans
(74) *Attorney, Agent, or Firm*—Roylance, Abrams, Berdo & Goodman, L.L.P.

(57) ABSTRACT

A highly corrosion resistant and paint adherent surface coating on aluminiferous metals can be provided very rapidly, if desired in less than one second, by contacting the surface with an aqueous acid liquid treating composition containing as solutes specified proportions of phosphate ions, titanium containing materials, fluoride, and an accelerator, the accelerator is preferably at least one of nitrous acid, nitric acid, tungstic acid, molybdic acid, permanganic acid, water soluble salts of all of these acids, and water-soluble organoperoxides.

22 Claims, No Drawings

COMPOSITION AND PROCESS FOR TREATING THE SURFACE OF ALUMINIFEROUS METALS

TECHNICAL FIELD

This invention relates to a novel liquid surface treatment composition and process for application to aluminiferous metals, which provide the surface of aluminiferous metals, i.e., aluminum and aluminum alloys containing at least 65% by weight of aluminum, with an excellent corrosion resistance and paint adherence. The present invention is applied with particularly good effect in the surface treatment of aluminum alloys in coil and sheet form.

BACKGROUND ART

Liquid compositions, which hereinafter are often called "baths" for brevity, even if used by some other method than immersion, that are in general use for treating the surface of aluminiferous metals can be broadly classified into chromate types and nonchromate types. Chromic acid chromate conversion baths and phosphoric acid chromate conversion baths are typical embodiments of chromate type treatment baths.

Chromic acid chromate conversion baths came into practical use in about 1950 and are still widely used even at present for heat exchanger fin stock and aviation vehicle components. The chromic acid chromate conversion baths contain chromic acid and fluoride as their main components, with the fluoride functioning as a reaction accelerator. These baths coat metal surfaces with conversion coatings containing some quantity of hexavalent chromium.

Phosphoric acid chromate conversion baths originated with the invention disclosed in U.S. Pat. No. 2,438,877. These conversion baths, which contain chromic acid, phosphoric acid, and hydrofluoric acid as their main components, coat metal surfaces with conversion coatings whose main component is hydrated chromium phosphate. Because these conversion coatings do not contain hexavalent chromium, they also are in wide use at present, for such applications as underpaint coatings for beverage can body and lid stock. Nevertheless, since these chromate type surface treatment baths do themselves contain toxic hexavalent chromium even though the coatings produced by them do not, hexavalent chromium-free treatment baths are desired in view of the environmental problems from disposal of the baths, rinse waters, and the like.

Typical of the inventions in the field of the chromium-free nonchromate type surface treatment baths is the process disclosed in Japanese Patent Application Laid Open [Kokai or Unexamined] Number Sho 52-131937 [131,937/1977]. The treatment bath in that reference consists of an acidic (pH approximately 1.5 to 4.0) aqueous coating solution containing phosphate, fluoride, and zirconium or titanium or both. Treatment of the metal surface with this surface treatment bath forms thereon a protective coating whose main component is zirconium or titanium oxide. (This type of coating is often called a "conversion" coating, because it is believed that it also contains cations from the substrate in the form of oxides and/or phosphates.) An advantage of nonchromate surface treatment baths is that they are free of hexavalent chromium, and this advantage has resulted in their wide use at the present time for treating the surface of drawn-and-ironed ("DI") aluminum cans and the like. However, the nonchromate baths require longer treatment times for coating formation than chromate surface treatment baths. Shortening surface treatment times has become an important issue in the last few years, because of the increasingly high line speeds being used to boost productivity. Moreover, nonchromate baths yield coatings with a corrosion resistance and paint adherence inferior to those of chromate coatings.

The treatment process disclosed in Japanese Patent Application Laid Open [Kokai or Unexamined] Number Hei 1-246370 [246,370/1989] is an invention whose object is to shorten the aforementioned surface treatment times. In this process, the aluminiferous metal surface is first cleaned with an alkaline degreaser and the cleaned surface is then treated with an acidic (pH 1.5 to 4.0) aqueous solution containing 0.01 to 0.5 g/L of zirconium ions, 0.01 to 0.5 g/L of phosphate ions, 0.001 to 0.05 g/L, measured as its stoichiometric equivalent as fluorine atoms, of "free" fluoride ions, and optionally 0.01 to 1 g/L of vanadium ions. However, when this process is applied to DI aluminum cans, the resulting film does not always have a satisfactory resistance to blackening.

Another nonchromate treatment process is disclosed in Japanese Patent Publication Number Sho 57-39314 [39,314/1982]. Disclosed therein is a treatment process in which the aluminiferous metal surface is treated with an acidic solution containing hydrogen peroxide, one or more selections from zirconium and titanium salts, and one or more selections from phosphoric acid and condensed phosphoric acids. However, this treatment bath is unstable, and, in addition, is also inadequately rapid in terms of surface coating formation. Moreover, this document does not provide a specific description or disclosure of the treatment time, treatment temperature, or treatment process.

It is for these reasons that nonchromate type surface treatment baths are at present almost never used on surface treatment lines for aluminiferous metal coil or sheet where short treatment times are critical.

In summary, then, there has yet to become established in the art a composition or process for treating the surface of aluminiferous metals that can provide short treatment times and is capable of forming a highly corrosion-resistant and strongly paint-adherent coating, but is free of hexavalent chromium.

DISCLOSURE OF THE INVENTION

Problem(s) to Be Solved by the Invention

The present invention is directed to solving the problems described above for the prior art. In specific terms, the present invention provides a composition and process for treating the surface of aluminiferous metals that are able to form rapidly a very corrosion-resistant and highly paint-adherent coating on the surface of aluminiferous metals.

SUMMARY OF THE INVENTION

It has been discovered that a surface treatment composition containing dissolved phosphate ions, dissolved titanium containing substance(s), and dissolved fluoride in particular relative quantities and a particular relative quantity of accelerator selected from a specific group of chemical substances can rapidly form a very corrosion-resistant and highly paint-adherent coating on the surface of aluminiferous metals. The present invention was achieved based on this discovery.

A concentrate or working composition according to the present invention for treating the surface of aluminiferous metals characteristically comprises, preferably consists essentially of, or more preferably consists of, water and the following materials in the relative proportions stated as follows: from 0.010 to 5 parts by weight of phosphate ions;

from 0.010 to 2.0 parts by weight, calculated as its stoichiometric equivalent as titanium atoms, of dissolved titanium containing substance(s); from 0.010 to 12 parts by weight, calculated as its stoichiometric equivalent as fluorine atoms, of dissolved molecules and/or anions containing fluorine; and from 0.010 to 2.0 parts by weight of dissolved accelerator. The bases for the specification of these particular weight proportions for each component will be explained in sequence in the discussion of the composition of preferred surface treatment baths, vide infra. Counterions for the necessary constituents explicitly recited above are also necessary if needed for electrical neutrality.

The accelerator increases the speed of coating formation and is selected from the group consisting of oxyacids, such as tungstic acid (i.e., $H_2WO_4$), molybdic acid (i.e., $HMoO_3$), permanganic acid (i.e., $HMnO_4$), nitric acid (i.e., $HNO_3$), nitrous acid (i.e., $HNO_2$), hypochlorous acid (i.e., HClO), chlorous acid (i.e., $HClO_2$), chloric acid (i.e., $HClO_3$), bromic acid (i.e., $HBrO_3$), iodic acid (i.e., $HIO_3$), perchloric acid (i.e., $HClO_4$), perbromio acid (i.e., $HBrO_4$), periodic acid (i.e, $HIO_4$), orthoperiodic acid (i.e., $H_5IO_6$), and salts of oxyacids; peroxoacids, such as peroxomonosulfuric acid (i.e., $H_2SO_5$), peroxodisulfuric acid (i.e., $H_2S_2O_8$), peroxomonophosphoric acid ($H_3PO_5$), peroxodiphosphoric acid (i.e., $H_4P_2O_8$), peroxomonocarbonic acid (i.e., $H_2CO_4$), peroxodicarbonic acid (i.e., $H_2C_2O_6$), and any of the peroxoboric acids (i.e., $HBO_3 \cdot \frac{1}{2}H_2O$, $HBO_4 \cdot H_2O$, or $HBO_5 \cdot H_2O$), and salts of peroxoacids; higher valent metal cations of metals with at least two stable cationic valence states, in cations that do not include oxygen, in aqueous solution, such as tetravalent cerium (i.e., $Ce^{+4}$), trivalent iron (i.e., $Fe^{+3}$), and tetravalent tin ($Sn^{4+}$); hydrogen peroxide ($H_2O_2$); and water-soluble organoperoxides. The use of an accelerator selected from this group in a treatment composition according to the present invention yields a substantial improvement in the speed of formation of a sufficiently thick coating to have protective qualities and in the corrosion resistance and paint adherence of the coating thereby formed.

The four necessary active ingredients in a composition according to the invention as described above need not necessarily all be provided by separate chemical substances. For example, fluotitanic acid is well suited to be a single source of both titanium and fluoride.

A process according to the present invention for treating the surface of aluminiferous metals characteristically comprises the formation thereon of a coating by bringing the surface of aluminiferous metal into contact, at a temperature from normal ambient temperature (i.e., at least 10 and more often at least 20° C.) to 80° C., with a surface treatment working composition, and thereafter subjecting the surface of the aluminiferous metal carrying the surface treatment bath to a rinse with water and, usually, drying, often with the use of heat.

DETAILED DESCRIPTION OF THE INVENTION, INCLUDING PREFERRED EMBODIMENTS

The source of the phosphate ions for a concentrate or working composition according to the present invention can be one or more selections from orthophosphoric acid (i.e., $H_3PO_4$) and neutral and acid salts thereof and condensed phosphoric acids, such as pyrophosphoric acid (i.e., $H_4P_2O_7$) and tripolyphosphoric acid (i.e., $H_5P_3O_{10}$) and neutral and acid salts of any of these. The particular phosphate ions source selected is not critical, and the stoichiometric equivalent as phosphate ions from any of these sources is considered to be phosphate ions for determining whether a composition is according to the invention and if so, what its degree of preference is, irrespective of the actual extent of ionization and condensation to form chemical species with P—O—P bonds that may exist in solution. The phosphate ions content in a working bath according to the present invention is preferably from 0.010 to 5.0 g/L, more preferably from 0.050 to 5.0 g/L, and even more preferably from 0.30 to 2.0 g/L. While a coating may be formed even at a phosphate ions concentration below 0.010 g/L, such coatings do not have an excellent corrosion resistance or paint adherence. The use of large concentrations—in excess of 5.0 g/L—is uneconomical: While good-quality coatings are formed at such levels, no additional benefits are obtained from the use of such large amounts, so that the cost of the treatment bath is raised without any offsetting benefit.

The source of the titanium containing substance(s) in a working or concentrate composition according to the present invention preferably is either a salt containing titanium and/or titanyl cations, the anions of which salt can be sulfate, fluoride, or the like, or fluotitanic acid or at least one of its salts, but the selection of the titanium containing substance (s) is not critical. The titanium containing substance(s) concentration in a surface treatment bath according to the invention should be from 0.010 to 2.0 g/L and is preferably from 0.10 to 2.0 g/L or more preferably from 0.10 to 1.0 g/L, in each instance calculated as titanium. The rapid formation of a satisfactory coating becomes quite problematic at a titanium content below 0.010 g/L. The use of large amounts—in excess of 2.0 g/L—is uneconomical: While good-quality coatings are formed at such levels, no additional benefits are obtained from the use of such large amounts and the cost of the treatment bath is raised.

The source of fluoride in the composition and surface treatment bath according to the present invention can be such fluorine-containing acids as hydrofluoric acid (i.e., HF), fluotitanic acid (i.e., $H_2TiF_6$), fluosilicic acid (i.e., $H_2SiF_6$), and fluozirconic acid (i.e., $H_2ZrF_6$), as well as any of their neutral and acid salts, but again the selection of the fluoride is not critical. The fluoride content in the surface treatment bath should be in the range from 0.010 to 12 g/L, preferably is from 0.050 to 5.0 g/L, and more preferably is from 0.10 to 3.0 g/L, in each case calculated as fluorine.

Aluminum ions eluting from the substrate are stabilized in the bath as aluminum fluoride by the fluoride, and the content levels given above include the quantity of fluoride necessary to do this. Aluminum fluoride has little effect on the coating-forming reactions. For example, a fluorine concentration of about 0.2 g/L is required in order to stabilize an aluminum concentration in the surface treatment bath of 0.1 g/L. Not counting the amount of fluorine required to produce aluminum fluoride, the optimal fluoride content for coating formation is from 0.010 to 5.0 g/L and preferably from 0.10 to 3.0 g/L, in each case calculated as fluorine. A fluorine content below 0.010 g/L results in an inadequate reactivity and hence in inadequate coating formation. On the other hand, levels in excess of 12 g/L result in an increased degree of etching that causes an undesirable unevenness in appearance, and such high levels also greatly complicate effluent treatment.

The accelerator functions in a surface treatment process according to the present invention to accelerate the rate of formation of the titanium coating on the metal surface and also to induce the formation of a highly corrosion-resistant and strongly paint-adherent coating. The accelerator concentration in the surface treatment bath must be in the range from 0.010 to 2.0 g/L and is preferably in the range from 0.10 to 1.1 g/L. No acceleration of the film-forming reaction is usually observed at an accelerator concentration below 0.010 g/L. The benefits from the accelerator do not further increase at accelerator levels in excess of 2.0 g/L, so that additions in excess of this level simply raise costs and are thus uneconomical.

An especially preferred accelerator includes at least one selection from the group consisting of nitrous acid, nitric acid, tungstic acid, molybdic acid, permanganic acid, all water-soluble salts of all of these acids, and water-soluble organoperoxides.

The nitrous acid/nitrite source is not critical as long as it is water-soluble; however, the use of the sodium salt (i.e., $NaNO_2$) or the potassium salt (i.e., $KNO_2$) of nitrous acid is usually preferred because of their relatively low cost. The nitric acid/nitrate source is also not critical, again as long as it is water-soluble; however, the use of the sodium salt (i.e., $NaNO_3$) or the potassium salt (i.e., $KNO_3$) of nitric acid (i.e., $HNO_3$) or of nitric acid itself is preferred because of their relatively low cost.

The tungstic acid/tungstate source is not critical as long as it is water-soluble; however, again the use of the sodium salt (i.e., $Na_2WO_4$) or potassium salt (i.e., $K_2WO_4$) of tungstic acid is preferred because of their relatively low cost.

The molybdic acid/molybdate source is not critical as long as it is water-soluble; however, the use of the sodium salt (i.e., $Na_2MoO_4$) or ammonium salt (i.e., $(NH_4)_6Mo_7O_{24}$) of simple or condensed molybdic acid respectively is preferred because of their relatively low cost.

The permanganic acid/permanganate selection is not critical as long as it is water-soluble; however, the use of the sodium salt (i.e., $NaMnO_4$) or potassium salt (i.e., $KMnO_4$) of permanganic acid is preferred because of their relatively low cost.

Preferred examples of water-soluble organoperoxide are tert-butyl hydroperoxide (i.e., $(CH_3)_3C—O—OH$), tert-hexyl hydroperoxide (i.e., $CH_3CH_2(CH_3)_2C—O—OH$), and di-tert-butyl peroxide (i.e., $(CH_3)_3C—O—O—C(CH_3)_3$).

A working surface treatment bath according to the present invention is most conveniently prepared from a concentrate composition according to the present invention, and the pH of a working bath must be in the range from 1.0 to 4.5. A pH below 1.0 causes an excessive etch of the metal surface by the treatment bath and thereby strongly impairs film formation. It becomes very problematic to obtain a highly corrosion-resistant and strongly paint-adherent coating at a pH in excess of 4.5. The more preferred pH range is 1.3 to 3.0. The pH of the surface treatment bath according to the present invention can be adjusted by adding an acid, e.g., nitric acid, sulfuric acid, hydrofluoric acid, or the like to lower the pH, or by adding an alkali, e.g., sodium hydroxide, sodium carbonate, ammonium hydroxide, or the like to raise the pH.

When in the practice of the present invention the metal substrate is composed of an alloy of aluminum with copper or manganese, the stability of the treatment bath may be substantially impaired by dissolution into the surface treatment bath of metal ions derived from the copper or manganese alloying component. In such a case, a difunctional organic acid or its alkali metal salt may be added as metal sequestering agent in order to chelate the aforementioned alloying metal ions. Examples of suitable organic acids are gluconic acid, heptogluconic acid, oxalic acid, tartaric acid, and ethylenediaminetetraacetic acid.

A working surface treatment bath according to the present invention may be brought into contact with the substrate to be treated by any convenient method and normally is used as part of a process sequence including other steps. A preferred generalized process sequence, for example, is as follows:

1. Surface cleaning: degreasing with an acidic, alkaline, or solvent-based system
2. Water rinse
3. Surface treatment with treatment bath according to the present invention treatment temperature: ambient temperature to 80° C. treatment time: 0.5 to 60 seconds treatment technique: spraying or dipping
4. Water rinse
5. Rinse with deionized water
6. Drying.

A treatment process according to the present invention is performed by bringing a working surface treatment bath as described above into contact with a surface of aluminiferous metal at from room temperature to 80° C. and preferably at from 35° C. to 70° C., for a contact time that is at least, with increasing preference in the order given, 0.50, 1.0, or 2.0 seconds and independently preferably is not more than, with increasing preference in the order given, 120, 90, 60, 50, 40, 30, 20, 10, 8.0, 5.0, 3.0, or 2.5 seconds. Treatment times below 0.5 second are associated with an insufficient reaction and hence may not yield the formation of a coating with good corrosion resistance and paint adherence. The properties of the coating do not usually improve further at treatment times above 120 seconds and in some instances do not improve further even after treatment times of a few seconds, while any extended treatment time increases the process cost.

The coating formed in a process according to the invention preferably contains a mass per unit area of 3 to 50, or more preferably of 5 to 30, milligrams per square meter (hereinafter usually abbreviated as "$mg/m^2$") of titanium atoms, which are measured as such by some method, such as X-ray fluorescence, that is independent of the chemical nature of the titanium atoms. When the surface coating mass is below 3 $mg/M^2$ as titanium, there is usually inadequate corrosion resistance by the resulting coating. At the other end of the range, there is usually an unsatisfactory paint adherence by the coating when the coating weight exceeds 50 $mg/m^2$.

The aluminiferous metals that may be subjected to surface treatment by a process according to the present invention encompass both pure aluminum and aluminum alloys, for example, Al—Cu, Al—Mn, Al—Mg, Al—Si, and Al—Zn alloys. The form and dimensions of the aluminiferous metal used in the invention process are not critical, and, for example, sheet and various molding shapes fall within the scope of the process.

Surface treatment baths and process according to the present invention will be illustrated in greater detail in the following through both working and comparison examples.

EXAMPLES

The treatment process sequence and other conditions outlined immediately below apply to each of Examples 1 to 9 and Comparison Examples 1 to 7.

Sample Material

Aluminum-magnesium alloy sheet according to Japanese Industrial Standard (hereinafter usually abbreviated as "JIS") 5182 was used.

Dimensions: 300 millimeters (hereinafter usually abbreviated as "mm")×200 mm.

Sheet thickness: 0.25 mm

Treatment Conditions

The conversion-treated sheet was prepared by the execution of the following processes in the sequence 1→2→3→4→5→6.

1. Degreasing (60° C., 10 seconds, spray) A 2% aqueous solution of a commercially available alkaline degreaser, FINECLEANER® 4377K from Nihon Parkerizing Company, Limited, was used.
2. Water rinse (ambient temperature, 10 seconds, spray)
3. Metal treatment according to the invention or a comparison thereto (spray)

The components used in the surface treatment baths, their concentrations in these baths, and the conditions for the processes according to the invention in Examples 1 to 9 and for Comparison Examples 1 to 5 are shown in tables below. The surface treatment conditions for Comparison Examples 6 and 7 are noted separately. An aqueous solution of 40% fluotitanic acid—a compound that is both a titanium containing substance(s) and a fluoride—was used in Examples 1, 4, 7, and 9 and in Comparison Example 2 as the source of both of these necessary components of a bath according to the invention. The entire amount of fluotitanic acid used is shown in the tables below under one column heading as a titanium source and under another heading as a fluoride source, but the amount was not in fact duplicated in the working bath. An aqueous solution of 67.5% nitric acid was used both as an accelerator and for pH adjustment in Examples 1 and 5.

4. Water rinse (ambient temperature, 10 seconds, spray)
5. Rinse with deionized water (ambient temperature, 5 seconds, spray)
6. Heating and drying (80° C., 3 minutes, hot-air oven)

A small sprayer was used for the degreasing, water rinse, rinse with deionized water, and treatment according to the invention or a comparison thereto. The particular small sprayer used was designed to reproduce the same spraying conditions as in a continuous surface treatment line for the actual treatment of aluminum alloy coil.

The following methods were used to test the coating weight, corrosion resistance, and paint adherence of the treated specimens.

(1) Coating Weight

The Ti or Zr add-on, in $mg/m^2$ on the treated sheet was measured using a fluorescent x-ray analyzer (RIX1000 from Rigaku Denki Kogyo Kabushiki Kaisha).

(2) Corrosion Resistance

Salt-spray testing according to JIS Z 2371 was used to evaluate the corrosion resistance. The development of corrosion on the treated sheet was visually evaluated after 150 hours of salt-spray testing, and the results were scored according to the following scale:

| | |
|---|---|
| +++: | corroded area was less than 10%; |
| ++: | corroded area was greater than or equal to 10%, but less than 50%; |
| +: | corroded area was greater than or equal to 50%, but less than 90%; |
| x: | corroded area was greater than or equal to 90%. |

(3) Paint Adherence

The surface of the conversion-treated aluminum-magnesium alloy sheet was painted with an epoxy-phenol paint for can lids to give a paint film thickness of 8 micrometers followed by baking for 3 minutes at 220° C. Polyamide film was then inserted between two of these painted surfaces with hot-press bonding at 200° C. for 2 minutes. The hot-press bonded composite was cut into 10 mm wide×120 mm long strips, which were the test specimens. A test specimen was peeled from the polyamide film using the T-peel test procedure, and the peel strength at this point was designated as the primary adherence. In order to evaluate the durability of the adherence to water, a test specimen prepared as described above was dipped in boiling deionized water for 60 minutes and then submitted to measurement of the peel strength in the same T-peel test procedure. The result in this case was designated as the secondary adherence.

Larger values for the peel strength are indicative of a better paint adherence. A performance sufficient for practical applications was a peel strength of at least 7.0 kilograms-force (hereinafter usually abbreviated as "kgf")/10 mm width in the case of the primary adherence and a peel strength of at least 5.0 kgf/10 mm width in the case of the secondary adherence.

Comparison Example 6

The same treatment process was run as in Example 1, except for using a 2% aqueous solution of a commercially available zirconium-based treatment agent, ALODINE™ 4040 from Nihon Parkerizing Company, Limited, as the surface treatment bath in process step 3. This treatment bath was sprayed on the same aluminum-magnesium alloy sheet as described above for 30 seconds at 40° C. The test results are reported in tables below.

Comparison Example 7

The same treatment was run as in Example 1, except for using a 2% aqueous solution of a commercially available zirconium-based treatment agent, ALODINE™ 4040, from Nihon Parkerizing Company, Limited, as the treatment bath. This bath was sprayed on the same aluminum-magnesium alloy sheet as described above for 5 seconds at 40° C. The test results are reported in tables below.

Benefits of the Invention

As the preceding description has made clear, application of a working treatment composition in a surface treatment process according to the present invention to aluminiferous metals rapidly forms a highly corrosion-resistant and strongly paint-adherent coating on the metal surface prior to the painting or forming thereof. Moreover, when the substrate aluminiferous metal is in the form of continuous coil or sheet, rapidity of the treatment supports higher production line speeds and permits compactness (space savings) of the treatment facilities.

In consequence of these effects, surface treatment concentrates, working baths, and processes according to the present invention for application to aluminiferous metals have a very high degree of practical utility.

TABLE 1

COMPONENTS USED IN THE TREATMENTS OF EXAMPLES 1 TO 9 AND COMPARISON EXAMPLES 1 TO 5, AND IDENTIFYING SYMBOLS THEREFOR

| | Source Material(s) | | |
|---|---|---|---|
| Component | Compound | Chemical Formula | Symbol |
| Phosphate ions | 85% Orthophosphoric acid in water | $H_3PO_4$ | a |
| Titanium containing substance(s) | 40% Fluotitanic acid in water | $H_2TiF_6$ | A |
| | 24% Titanic sulfate in water | $Ti(SO_4)_2$ | B |
| | Titanyl sulfate in water, 10% Ti | $TiOSO_4$ | C |
| Fluoride | 40% Fluotitanic acid in water | $H_2TiF_6$ | A |
| | 20% Hydrofluoric acid in water | HF | a |
| | 40% Fluosilicic acid in water | $H_2SiF_6$ | b |
| | 96% Ammonium acid fluoride in water | $NH_4HF_2$ | c |
| Accelerator | 67.5% Nitric Acid in water | $HNO_3$ | T |
| | Potassium permanganate | $KMnO_4$ | U |
| | 97% Pure Sodium Nitrite | $NaNO_2$ | V |
| | Sodium tungstate dihydrate | $Na_2WO_4.2H_2O$ | W |
| | Ammonium heptamolybdate tetrahydrate | $(NH_4)_6Mo_7O_{24}.4H_2O$ | X |
| | 69% Tert-butyl hydroperoxide in water | $(CH_3)_3C—O—OH$ | Y |
| | 5% Stannic chloride in water | $SnCl_4$ | Z |
| pH Regulator | 67.5% Nitric acid in water | $HNO_3$ | T |
| | 97% Sulfuric acid in water | $H_2SO_4$ | a |
| | 25% ammonia in water | $NH_4OH$ | b |

TABLE 2

COMPOSITIONS OF SURFACE TREATMENT BATHS ACCORDING TO THE INVENTION

| | Grams per Liter in Bath of: | | | | | |
|---|---|---|---|---|---|---|
| Example Number | Ti Compound/ (Ti) | Phosphate Source/ ($PO_4^{-3}$) | Fluoride Source/ (F) | Accelerator Source/(Active Accelerator) | pH Regulator Type | pH of Bath |
| 1 | 5.0 of A/ (0.58) | 1.0 of a/ (0.82) | 5.0 of A/ (1.39) | 1.00 of T/ (0.68) | T | 1.3 |
| 2 | 2.0 of C/ (0.20) | 0.2 of a/ (0.16) | 0.5 of a/ (0.10) | 0.10 of W/ (0.09) | a | 1.8 |
| 3 | 30.0 of B/ (1.44) | 4.0 of a/ (3.30) | 15.0 of a/ (2.85) | 0.50 of V/ (0.49) | a | 1.0 |
| 4 | 10.0 of A/ (1.17) | 1.0 of a/ (0.82) | 10.0 of A/ (2.78) | {1.00 of V/ (0.97)} + {0.10 of U/(0.10)} | b | 1.5 |
| 5 | 20.0 of B/ (0.96) | 1.5 of a/ (1.24) | {0.5 of a/ (0.10} + {0.5 of b/ (0.16) | {0.30 of T/ (0.20)} + {0.05 of X/(0.05)} | T | 1.3 |
| 6 | 5.0 of C/ (0.48) | 1.0 of a/ (0.82) | 2.0 of c/ (1.28) | {0.30 of Y/ (0.21)} + {0.10 of W/(0.10)} | b | 4.2 |
| 7 | {0.30 of A/ (0.35)} + {5.0 of C/ (0.50)} | 2.5 of a/ (2.06) | {3.0 of A/ (0.83)} + {2.0 of c/ (1.28)} | 1.0 of Y/ (0.69) | b | 2.5 |
| 8 | 1.0 of B/ (0.05) | 0.04 of a/ (0.03) | 0.2 of b/ (0.06) | 0.03 of U/ (0.03) | b | 4.0 |
| 9 | 2.0 of A/ (0.23) | 0.5 of a/ (0.41) | 2.0 of A/ (0.56) | 3.00 of Z/ (0.15) | a | 1.6 |

TABLE 3

COMPOSITIONS OF SURFACE TREATMENT BATHS FOR COMPARISON EXAMPLES 1 TO 5

| Comparison Example Number | Grams per Liter in Bath of: Ti Compound/(Ti) | Phosphate Source/($PO_4^{-3}$) | Fluoride Source/(F) | Accelerator Source/(Active Accelerator) | pH Regulator Type | pH of Bath |
|---|---|---|---|---|---|---|
| 1 | none | 1.0 of a/(0.82) | 0.5 of b/(0.16) | 1.00 of V/(0.97) | a | 1.3 |
| 2 | 5.0 of A/(0.58) | none | 5.0 of A/(1.39) | 0.30 of W/(0.27) | b | 1.6 |
| 3 | 10.0 of C/(1.00) | 1.5 of a/(1.24) | none | 1.0 of Y/(0.69) | a | 1.2 |
| 4 | 30.0 of B/(1.44) | 4.0 of a/(3.30) | 5.0 of a/(0.95) | 0.5 of V/(0.49) | b | 5.0 |
| 5 | 10.0 of B/(0.48) | 1.0 of a/(0.82) | 5.0 of a/(0.95) | none | b | 1.5 |

TABLE 4

PROCESS CONDITIONS AND EVALUATION TEST RESULTS

| Example ("Ex") or Comparison Example ("CE") Number | Conditions During Treatment According to the Invention or Comparison: Temperature, ° C. | Contact Time, Seconds | Add-on Mass of Ti, mg/m² | Rating after 150 Hour Salt Spray Test | Paint Adherence, kgf/10 mm of Width: Primary | Secondary |
|---|---|---|---|---|---|---|
| Ex 1 | 40 | 6 | 15 | +++ | 10.8 | 8.3 |
| Ex 2 | 45 | 40 | 20 | +++ | 9.4 | 6.7 |
| Ex 3 | 40 | 5 | 12 | +++ | 9.0 | 6.7 |
| Ex 4 | 65 | 2 | 15 | +++ | 11.4 | 9.2 |
| Ex 5 | 35 | 5 | 4.5 | +++ | 10.5 | 9.0 |
| Ex 6 | 45 | 8 | 43 | +++ | 9.3 | 6.8 |
| Ex 7 | 60 | 4 | 25 | +++ | 8.9 | 7.8 |
| Ex 8 | 35 | 50 | 9.0 | +++ | 7.5 | 5.3 |
| Ex 9 | 50 | 12 | 20 | +++ | 7.2 | 5.5 |
| CE 1 | 50 | 10 | 0 | × | 3.8 | 1.0 |
| CE 2 | 55 | 5 | 20 | + | 6.0 | 2.9 |
| CE 3 | 35 | 40 | 1.0 | × | 4.0 | 1.3 |
| CE 4 | 45 | 8 | 17 | ++ | 5.2 | 3.4 |
| CE 5 | 60 | 30 | 2.0 | × | 5.0 | 1.3 |
| CE 6 | 40 | 30 | *18 of Zr | ++ | 7.2 | 5.0 |
| CE 7 | 40 | 5 | *5 of Zr | + | 4.6 | 2.7 |

Footnote for Table 4

*There is no titanium added in these comparison examples, which used a treatment composition that does not contain titanium.

What is claimed is:

1. An aqueous liquid composition that is suitable for treating the surface of aluminiferous metals to form a corrosion protective and paint-adherent coating thereon, said composition comprising the following components in relative amounts as recited below:

(A) from 0.01 to 5 parts by weight of dissolved phosphate ions;

(B) from 0.1 to 2 parts by weight, calculated as their stoichiometric equivalent as titanium atoms, of dissolved molecules, ions, or both that contain titanium atoms;

(C) from 0.05 to 5 parts by weight, calculated as their stoichiometric equivalent as fluorine atoms, of dissolved molecules, anions, or both that contain fluorine atoms; and (D) from 0.01 to 2 parts by weight of water soluble accelerator that is a combination of (a) sodium nitrite and potassium permanganate or (b) nitric acid and ammonium heptamolybdate.

2. A composition according to claim 1, wherein the accelerator further comprises at least one material selected from the group consisting of nitrous acid, permanganic acid, water-soluble salts of all of the preceding acids, and water-soluble organoperoxides, and, optionally, also contains nitrate ions.

3. A working composition according to claim 2, wherein the composition has a pH from 1.0 to 4.5 and contains from 0.01 to 5 g/L of dissolved phosphate ions, from 0.01 to 2 g/L of dissolved molecules that contain titanium atoms, calculated as titanium atoms;

from 0.01 to 12 g/L of dissolved molecules that contain fluorine atoms, calculated as fluorine atoms; and 0.01 to 2 g/L of accelerator.

4. A working composition according to claim 3, wherein the composition contains from 0.05 to 5 g/L of dissolved phosphate ions, from 0.10 to 2 g/L of dissolved molecules that contain titanium atoms, calculated as titanium atoms; and from 0.05 to 5.0 g/L of dissolved molecules that contain fluorine atoms, calculated as fluorine atoms.

5. A working composition according to claim 4, wherein the composition has a pH from 1.3 to 3.0 and contains from 0.30 to 2.0 g/L of dissolved phosphate ions, from 0.10 to 1.0 g/L of dissolved molecules that contain titanium atoms, calculated as titanium atoms;

from 0.10 to 2.0 g/L, calculated as fluorine atoms, of dissolved molecules, anions, or both that contain fluorine atoms; and from 0.10 to 1.1 g/L of accelerator.

6. A working composition according to claim 1, wherein the composition has a pH from 1.0 to 4.5 and contains from 0.01 to 5 g/L, of dissolved phosphate ions;

from 0.01 to 2 g/L, of dissolved molecules that contain titanium atoms, calculated as titanium atoms;

from 0.01 to 12 g/L of dissolved molecules that contain fluorine atoms, calculated as fluorine atoms; and 0.01 to 2 g/L of accelerator.

7. A working composition according to claim 6, wherein the composition contains from 0.05 to 5 g/L of dissolved phosphate ions;

from 0.10 to 2 g/L of dissolved molecules that contain titanium atoms, calculated as titanium atoms; and from 0.05 to 5.0 g/L of dissolved molecules that contain fluorine atoms, calculated as fluorine atoms.

8. A working composition according to claim 7, wherein the composition has a pH from 1.3 to 3.0 and contains from 0.30 to 2.0 g/L of dissolved phosphate ions;

from 0.10 to 1.2 g/L of dissolved molecules that contain titanium atoms, calculated as titanium atoms;

from 0.10 to 2.8 g/L of dissolved fluorine atoms, calculated as fluorine atoms; and from 0.10 to 1.1 g/L of accelerator.

9. A process for treating an aluminiferous metal surface, said process comprising steps of:

(I) bringing the aluminiferous metal surface into contact, at a temperature from normal ambient temperature to 80° C., with a working composition according to claim 8 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

10. A process according to claim 9, wherein a coating weight of from 3 to 50 mg/m$^2$ calculated as titanium is produced on the aluminiferous metal surface during the process.

11. A process for treating an aluminiferous metal surface, said process comprising steps of:

(I) bringing the aluminiferous metal surface into contact, at a temperature from normal ambient temperature to 80° C., with a working composition according to claim 7 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

12. A process according to claim 11, wherein a coating weight of from 3 to 50 mg/M$^2$ calculated as titanium is produced on the aluminiferous metal surface during the process.

13. A process for treating an aluminiferous metal surface, said process comprising steps of:

(I) bringing the aluminiferous metal surface into contact, at a temperature from normal ambient temperature to 80° C., with a working composition according to claim 6 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

14. A process according to claim 13, wherein a coating weight of from 3 to 50 mg/m$^2$ calculated as titanium is produced on the aluminiferous metal surface during the process.

15. A process for treating an aluminiferous metal surface, said process comprising steps of:

(I) bringing the aluminiferous metal surface into contact, at a temperature from normal ambient temperature to 80° C., with a working composition according to claim 5 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

16. A process according to claim 15, wherein a coating weight of from 3 to 50 mg/m$^2$ calculated as titanium is produced on the aluminiferous metal surface during the process.

17. A process for treating an aluminiferous metal surface, said process comprising steps of:

(I) bringing the aluminiferous metal surface into contact, at a temperature from normal ambient temperature to 80° C., with a working composition according to claim 4 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

18. A process according to claim 17, wherein a coating weight of from 3 to 50 mg/m$^2$ calculated as titanium is produced on the aluminiferous metal surface during the process.

19. A process for treating an aluminiferous metal surface, said process comprising steps of:

(I) bringing the aluminiferous metal surface into contact, at a temperature from, normal ambient temperature to 80° C., with a working composition according to claim 3 for a time of at least 0.5 second; and (II) discontinuing the contact established in step (I) and thereafter subjecting the aluminiferous metal surface carrying residue of the surface treatment bath to a rinse with water; and, optionally, (III) drying the rinsed surface from the end of step (II).

20. A process according to claim 19, wherein a coating weight of from 3 to 50 $mg/m^2$ calculated as titanium is produced on the aluminiferous metal surface during the process.

21. A composition according to claim 1, wherein said accelerator further comprises at least one material selected from the group consisting of nitrous acid, nitric acid, permanganic acid, water soluble salts of these acids, and water soluble organoperoxides.

22. A composition according to claim 1 further comprising a difunctional organic acid or its alkali metal salt sequestering agent for copper or aluminum ions dissolved into said composition wherein said difunctional organic acid is selected from the group consisting of heptogluconic acid, oxalic acid, tartaric acid, and ethylenediaminetetraacetic acid.

* * * * *

UNITED STATES PATENT AND TRADEMARK OFFICE

CERTIFICATE OF CORRECTION

PATENT NO. : 6,193,815 B1
DATED : February 27, 2001
INVENTOR(S) : Wada et al.

It is certified that error appears in the above-identified patent and that said Letters Patent is hereby corrected as shown below:

Title page,
Item [57], ABSTRACT,
Line 4, delete "acid", and insert therefor -- acidic --.
Line 7, after "accelerator", delete "," and insert therefor -- ; --.

Column 13,
Lines 22 and 23, after "g/L", delete ",".

Column 14,
Line 7, delete "mg/$M^2$" and insert therefor -- mg/$m^2$ --.
Line 60, after "from", delete ",".

Signed and Sealed this

Tenth Day of June, 2003

JAMES E. ROGAN
*Director of the United States Patent and Trademark Office*